US006582192B2

(12) United States Patent
Tseng

(10) Patent No.: US 6,582,192 B2
(45) Date of Patent: Jun. 24, 2003

(54) OMNIDIRECTIONAL ELECTRIC FAN

(76) Inventor: Shou-Tang Tseng, No.22, Alley.35, Jong-Shen 1st Rd., Da-Ya Village, Taichung County (TW)

( * ) Notice: Subject to any disclaimer, the term of this patent is extended or adjusted under 35 U.S.C. 154(b) by 7 days.

(21) Appl. No.: 09/915,295

(22) Filed: Jul. 27, 2001

(65) Prior Publication Data

US 2003/0021682 A1 Jan. 30, 2003

(51) Int. Cl.[7] ..... F04D 29/56
(52) U.S. Cl. ..... 415/211.1; 415/211.2
(58) Field of Search ..... 416/247 R; 915/208.1, 915/208.2, 208.3, 211.1, 211.2; D23/370, 377, 392

(56) References Cited

U.S. PATENT DOCUMENTS

| | | | | | |
|---|---|---|---|---|---|
| 1,897,860 | A | * | 2/1933 | Persons | 415/121.3 |
| D112,847 | S | * | 1/1939 | Roffy | D23/377 |
| D120,033 | S | * | 4/1940 | Kisling | D23/377 |
| D128,185 | S | * | 7/1941 | Welch | D23/377 |
| D144,034 | S | * | 3/1946 | Budlong | D23/377 |
| 2,420,209 | A | * | 5/1947 | Strom | 417/424.2 |
| D150,559 | S | * | 8/1948 | Eckles | D23/377 |
| D160,391 | S | * | 10/1950 | Hutcheson | D23/377 |
| D160,948 | S | * | 11/1950 | Kisling | D23/377 |
| D161,887 | S | * | 2/1951 | Welch, Sr. | D23/377 |
| D162,627 | S | * | 3/1951 | Camiel | D23/377 |
| 2,616,617 | A | * | 11/1952 | Hill | 415/211.2 X |
| 2,618,435 | A | * | 11/1952 | Koch | 415/211.1 |
| 2,625,319 | A | * | 1/1953 | Reisch | 417/424.1 |
| 2,628,018 | A | * | 2/1953 | Koch | 415/186 |
| 2,640,646 | A | * | 6/1953 | Jones | 415/211.2 |
| 2,642,220 | A | * | 6/1953 | Koch | 415/121.3 |
| 2,652,193 | A | * | 9/1953 | Lindberg et al. | 415/211.2 X |
| D171,555 | S | * | 2/1954 | Podall | D23/377 |
| 2,905,377 | A | * | 9/1959 | Gow | 415/143 |
| D245,511 | S | * | 8/1977 | Lewis | D23/377 |
| 4,217,816 | A | * | 8/1980 | Mancinelli | 415/125 X |
| 4,473,382 | A | * | 9/1984 | Cheslock | 96/585 |
| 5,193,984 | A | * | 3/1993 | Lin | 416/247 R |
| 5,435,695 | A | * | 7/1995 | Chiu et al. | 416/244 R |

* cited by examiner

*Primary Examiner*—Edward K. Look
*Assistant Examiner*—Richard A. Edgar
(74) *Attorney, Agent, or Firm*—Rosenberg, Klein & Lee

(57) ABSTRACT

An onmibearing electric fan is mainly composed of a casing, a fan set, a tapered diversion plate or a streamlined diversion casing, and a plurality of diffusion plates, wherein the fan set is locked inside the casing, and more than one wind outlets are set on the erect plane of the casing. The more than one wind outlets respectively work in coordination with each diffusion plate sets. The top of the casing has a tapered diversion plate or a streamlined diversion casing, wherein the top of the tapered diversion plate or the top of the streamlined diversion casing face to fan set. The function of blowing wind omnidirectionally can be accomplished by adding a plurality of holding legs at the bottom or an arbitrary side of the present invention.

16 Claims, 11 Drawing Sheets

OMNIDIRECTIONAL ELECTRIC FAN

BACKGROUND OF THE INVENTION

1. Field of the Invention

The present invention relates to an omnidirectional electric fan, especially to a new one which can gather air absorbed into the casing via a tapered diversion plate or a streamlined diversion casing by the fan set, and then control the direction of the air flow by diffusion plate set to make air blow to the outside direction from the casing in holderer order of passing through the fan set and the diffusion set such that air convention is increased.

2. Description of the Prior Art

In order to produce air convention to keep indoor air clear, commonly used method are to use some electric products such as an air conditioning, an electric fan, and a cooling fan, etc. Among these electric products, an electric fan is the most commonly known and used due to some factors such as economics and convenience in usage, etc, and can make the indoor space get better air convention. In general, the type of an electric fan which can change the direction of blowing out or the angle of spreading the air flow, and so on, is more popular for consumers.

Among products of electric fans in market, the more popular type is the one hanging a protective shield, and having an oscillating fan head. There is only one direction of blowing for this type. Therefore, when the user wants the function of blowing to multi-direction, the fan head needs keeping on turning. However, at each angle of turning of the fan head, air flow is only blown in one direction, and furthermore, the turning angle of the fan head is limited due to the mechanical structure for some products. There is another type of electric fan, which is the "multi-direction type" electric fan. The product of this type is to cover a diffusion plate shaped in sole process onto the vertical fan head, and the direction of diffusion plate is fixed. When the electric fan rotates, the diffusion plate can rotate slowly, too. Due to that the diffusion plate rotate with slow speed, air can be guided out in different direction via the diffusion blades of the diffusion plate. The type is limited to the direction of the erect surface of the electric fan (varying angle of the direction of the wind is smaller than 180°). Besides, there is an electric fan claimed to enable to blow air flow in 360° (Taiwan Patent Number 272578). The electric fan described above makes air flow blow out transversely and horizontally by working of an upper motor and a lower motor with coordination of ability of changing direction of a ramp diffusion set. However, after the electric fan rotates for a circle, a summing wind can be got twice at the same position. From the situation, we know that a dead angle exists such that the motors doesn't enable to blow wind at every angle at the same time. Besides, the electric fan needs two motors to work in coordination at the same time, so it is not economical for the produce cost and is too high in price. In addition, the electric fan is not a good design in the aspect of arrangement of the whole space and configuration of the structure.

Therefore, the common used electric fans described above have many disadvantages and are really not a perfect design needing improving.

The inventor of the invention ruminated over the disadvantages resulted from the common seen electric fans described above. After studying hard for a long period, the inventor finally succeed in inventing the onmidirectional electric fan.

SUMMARY OF THE INVENTION

The purpose of the present invention is to provide an omnidirectional electric fan, which has more than one wind outlets on the erect plane to make the present invention has the characteristic of blowing wind to multi-direction at the same time.

The second purpose of the present invention is to provide an omnidirectional electric fan, which has a tapered diversion plate set at the end plane of the casing to gather wind absorbed by a fan and then absorbed air is blown out.

The third purpose of the present invention is to provide an omnidirectional electric fan, which has diffusion plate sets set on the wind outlets set on the casing to adjust the direction of blowing wind by the ability of turning of the diffusion plates of the diffusion plate sets.

The another purpose of the present invention is to provide an omnidirectional electric fan, which can make air keep on convecting even if the present invention is used under handstand situation due to that the fan is locked in the casing and located inside the range of the wind outlets.

The other purpose of the present invention is to provide an omnidirectional electric fan, which can be added more than one holding legs at any side of the present invention to set the present invention in standing way, seat way, or handstand way conveniently. Besides, applying several diffusion plate sets can let the function of choosing the multi-directions of blowing wind be used amply.

The omnidirectional electric fan which can achieve purposes described above comprises:

an casing, which is formed by extending vertically from the end place which has an arbitrary geometric shape, wherein more than one wind outlets are set at the erect plane;

a fan set, which further comprises a motor fastened to the holder, and a fan slipped on the axis of the motor;

a tapered diversion plate, which is a case; and more than one diffusion plate sets;

the fan set is locked on the holder, which is locked at the proper position inside the casing. More than one diffusion plate sets are respectively composed of more than one diffusion plates which can turn, and are respectively able to be set at the top of more than one wind outlets set on the erect plane of the casing. The tapered diversion plate is covered on an end plane of the casing, or is shaped together with the casing in sole process due to the design. The top of the tapered diversion plate faces to the fan set. The casing further can coordinate with an upper cover due to the design, and the upper cover can be covered onto the bottom of the taper of the tapered diversion plate and also simultaneously covered to the end plane of the casing.

An omnidirectional electric fan which can achieve the purposes described above can be constructed by another way to be applied, which mainly comprises:

A casing, which comprises a polygonal base casing and a tapered casing extended from and having corresponding number of edges of the polygonal base casing (or the base casing is assembled with the casing). The polygonal base casing is extended vertically from an end plane having an arbitrary geometric shape. Besides, an end plane of the tapered casing has a streamline diversion casing thereon. The streamlined diversion casing and the tapered casing can be formed in sole process or separately. More than one wind outlets are set on the ramp taper plane of the tapered casing, and more than one wind inlets formed in arbitrary geometric form are set at the proper positions on the lateral side of polygonal base casing;

A fan set, which further comprises a motor, and a fan slipped on the shaft of the motor. The fan is composed of more than one spoiler blades;

More than one diffusion plate sets, which are composed of more than one diffusion plates which are rotatory;

More than one holding legs.

The motor of the fan set is locked at the bottom position of the casing, and the more than one diffusion plates are respectively set on the more than one wind outlets set on the ramp taper plane of the tapered casing. The top of the streamlined diversion casing faces to the fan set. The more than one holding legs are set at the end plane of the casing or an arbitrary side of the casing to make the present invention be used in standing way, seat way, or handstand way.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
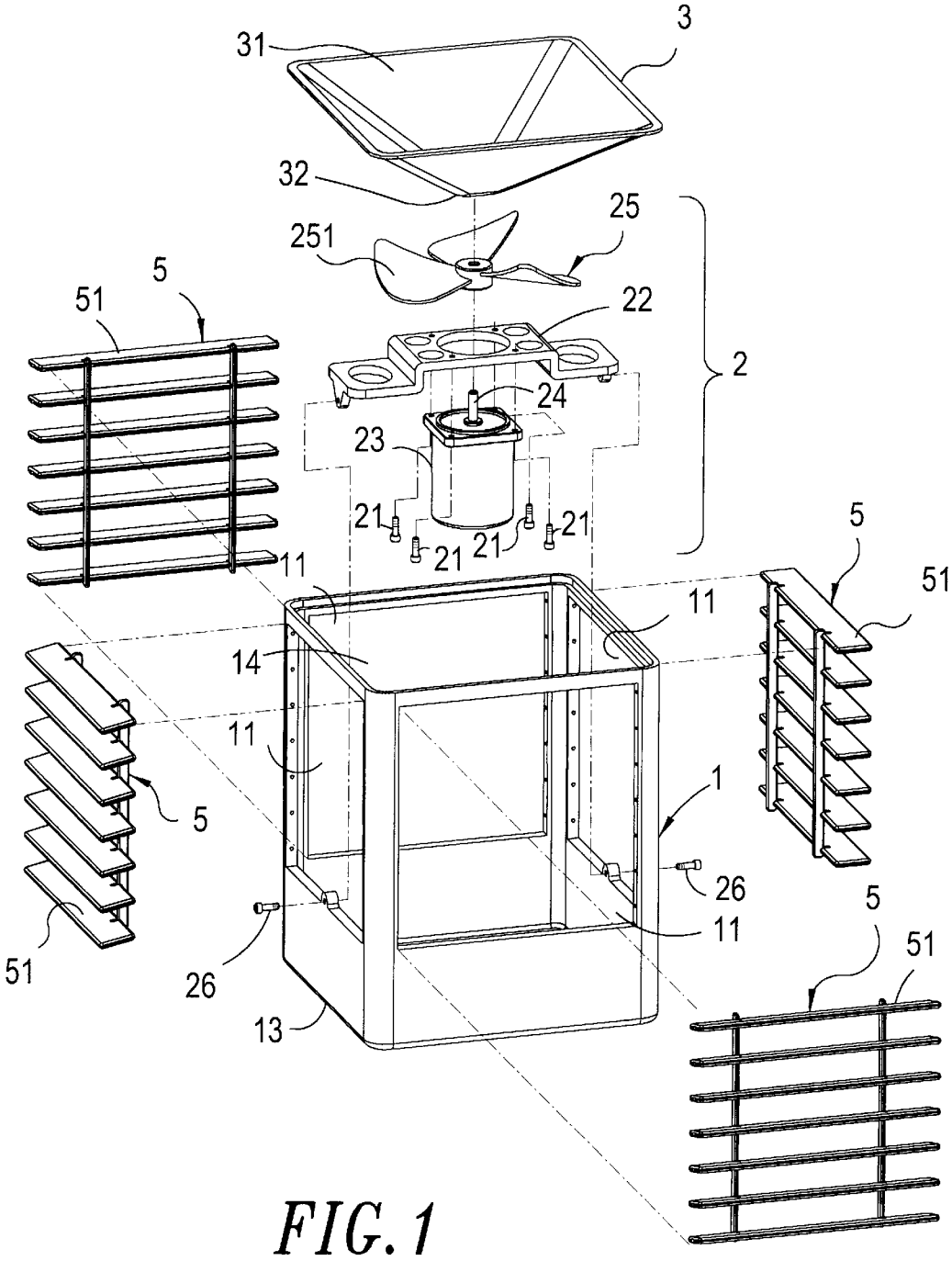
FIG. 1 is the 3D exploded view of the present invention, an omnidirectional electric fan.
Figure 2:
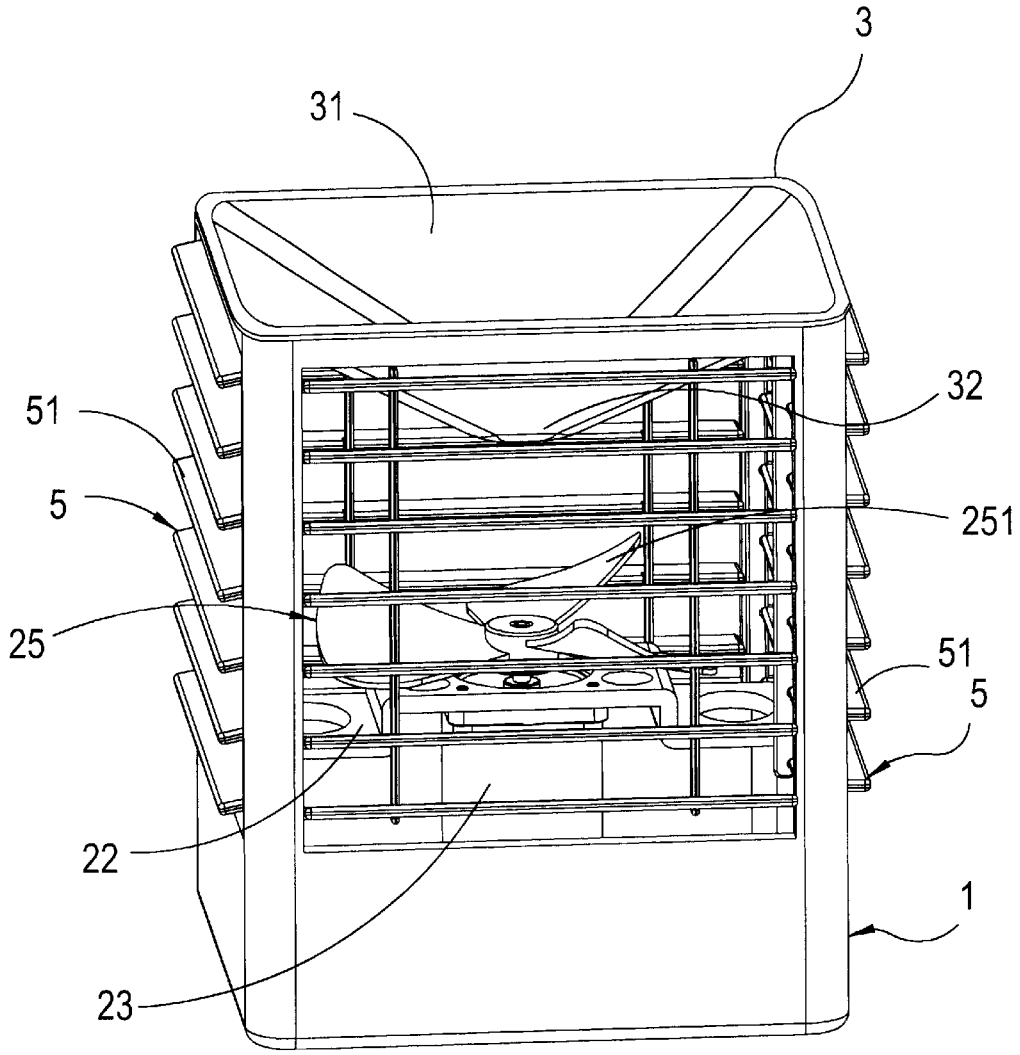
FIG. 2 is the 3D view of the better first example an omnidirectional electric fan.

Referring to FIG. 1 and FIG. 2, whereof FIG. 1 is the 3D exploded view of the present invention, an omnidirectional electric fan, and FIG. 2 is the 3D view of better first example of an omnidirectional electric fan, the present invention mainly comprises a casing 1, a fan set 2, a tapered diversion plate 3 and more than one diffusion plate sets 5. The casing 1 is formed by being extended vertically from the end plane 13 which has an arbitrary geometry form. Otherwise, more than one wind outlets 11 are set at the erect plane 13 of the casing 1. The fan set 2 comprises a motor 23 fastened to the holder 22 by screws 21, and a fan 25 slipped on the shaft 24 of the motor 23. The fan 25 is composed of more than one spoiler blades 251. The tapered diversion plate 3 is a case and can be designed to be shaped together with the casing 1 in sole process. The more than one diffusion plate sets 5 are respectively composed of more than one rotatory diffusion plates 51. The holder 22 of the fan set 2 is locked at the proper position inside the casing via screws 26. The more than one diffusion plate set 5 are respectively able to be set at the top of more than one wind outlets 11 set on the erect plane of the casing 1. The tapered diversion plate 3 is covered on an end plane 14 of the casing 1. The taper top 32 of the tapered diversion plate 3 faces to the fan set 2.

Figure 3:
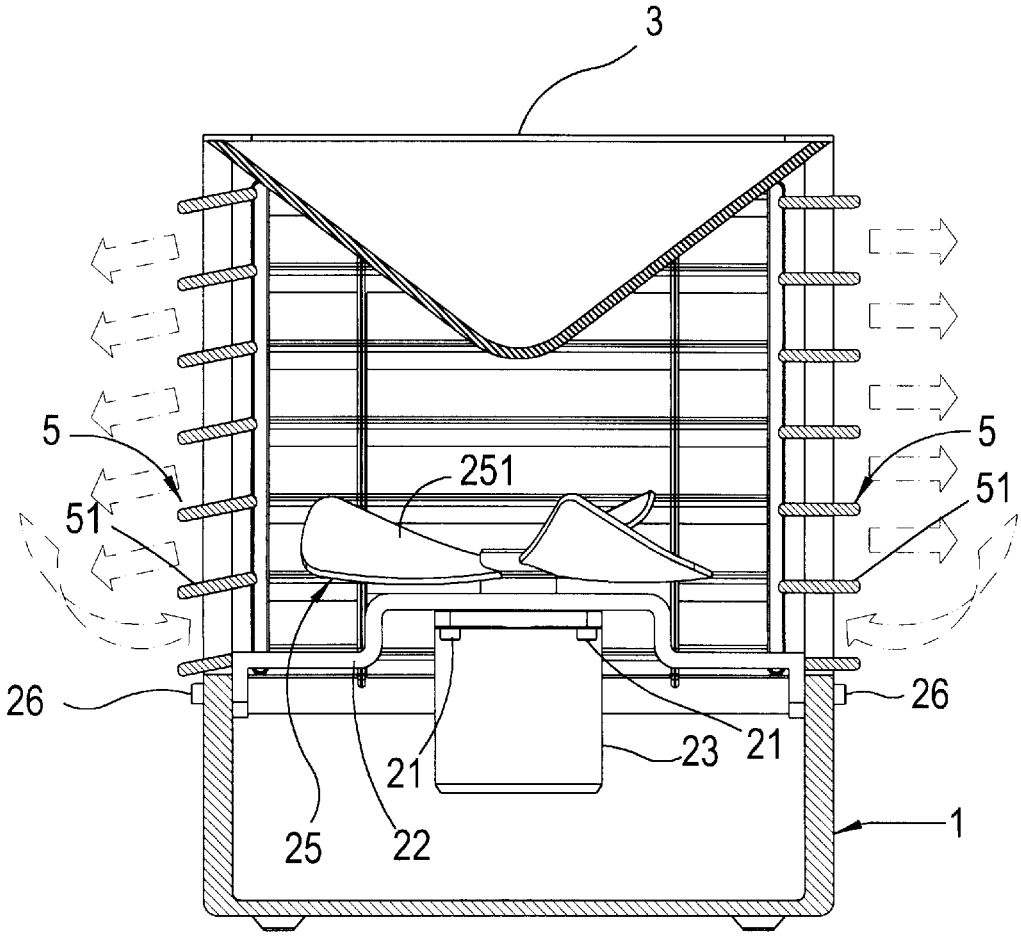
FIG. 3 is the sectional drawing of an omnidirectional electric fan.

Referring to FIG. 3, which is the sectional drawing of an omnidirectional electric fan, when the fan blades 251 of the fan 25 of the fan set 2 are driven to rotate by the motor 23, air outside the casing 1 can be absorbed into the casing 1 through the diffusion plate sets 5 because of the spoiling effect of spoiler blades 251 (the angle of the diffusion plates 51 of the diffusion plate sets 5 can be adjusted by the user's self). The air absorbed into the casing 1 can be gathered due to the gathering effect of the tapered diversion plate 3. At the same time, because the fan 25 still keeps on absorbing external air, the absorbed air is compressed slightly. In this way, as long as the absorbed air is gathered to a certain amount, air can be blown out quickly through the diffusion plates 51 of the diffusion plate sets 5 such that the effect of making indoor air convect is accomplished.

Figure 4:
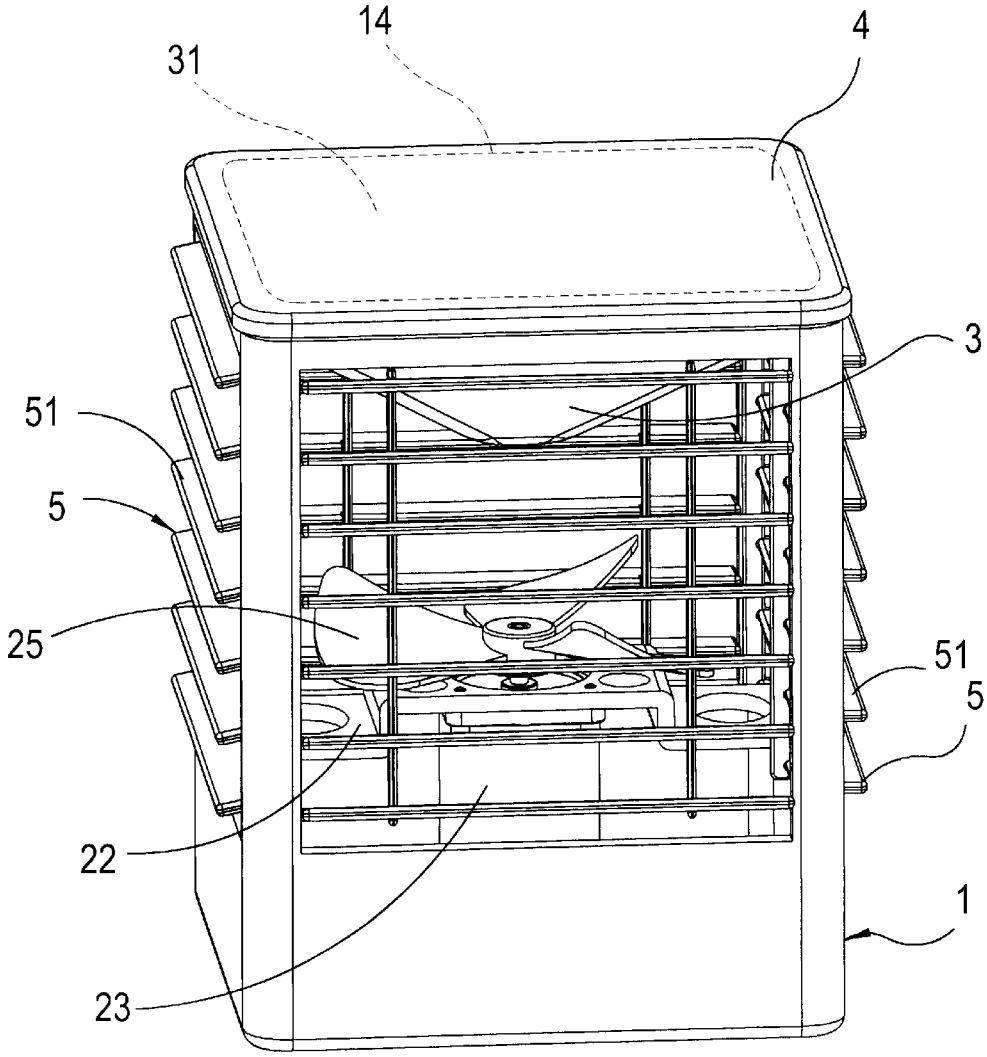
FIG. 4 is the drawing of second example an omnidirectional electric fan.

Referring to FIG. 4, which is the drawing of second example of an omnidirectional electric fan, the taper bottom 31 of the tapered diversion plate 3 can be covered with an upper cover 4 which can simultaneously be covered on the end plane 14 of the casing 1 having the tapered diversion plate 3.

Figure 5:
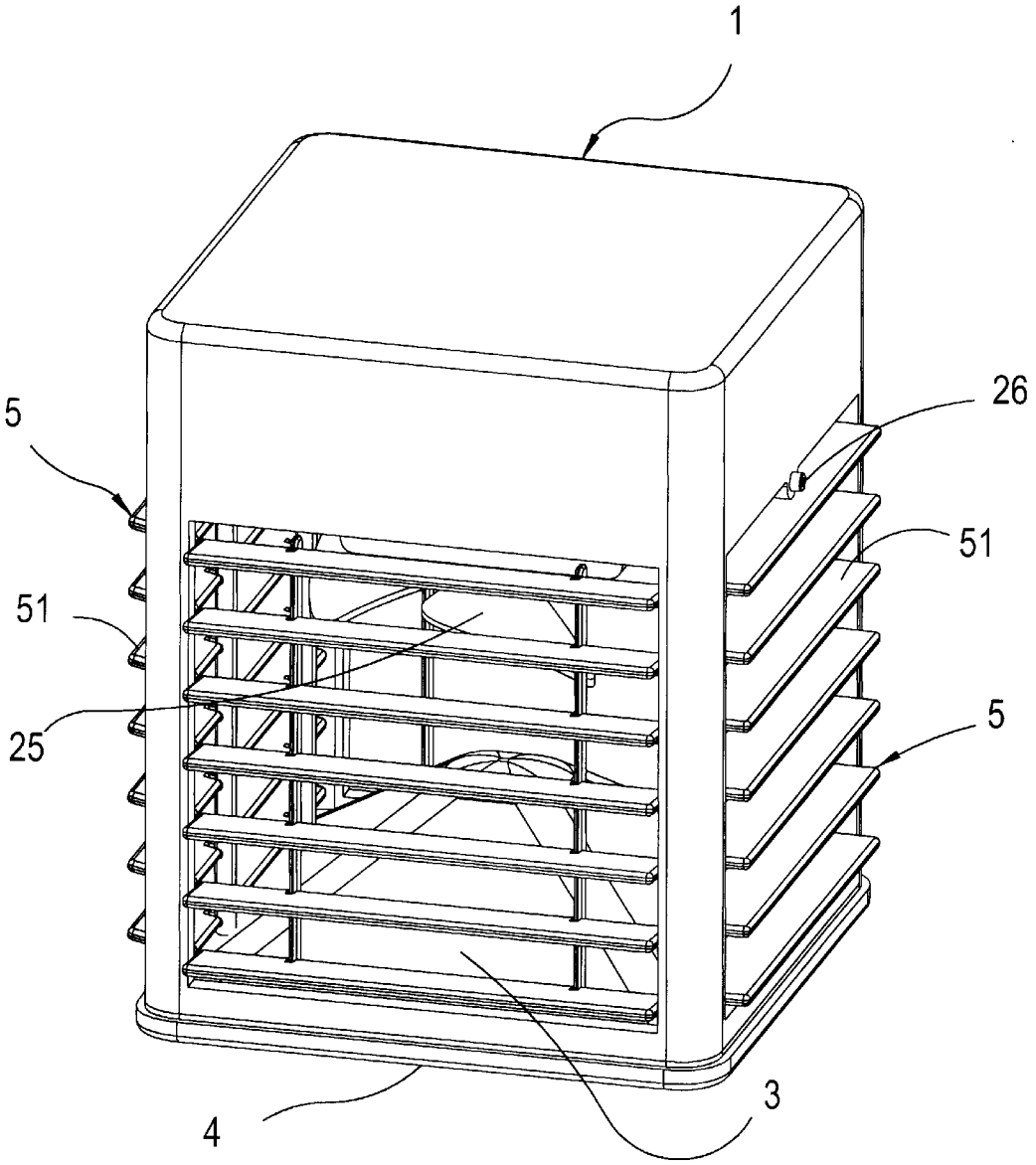
FIG. 5 is the drawing of third example of an omnidirectional electric fan.

Referring to FIG. 5, which is the drawing of third example of an omnidirectional electric fan, this figure illustrates that the fan set 2 of the present invention is locked insides the casing 1, and is located inside the range of the wind outlets such that the present invention can keep the function of convection in spite of under handstand situation.

Figure 6:
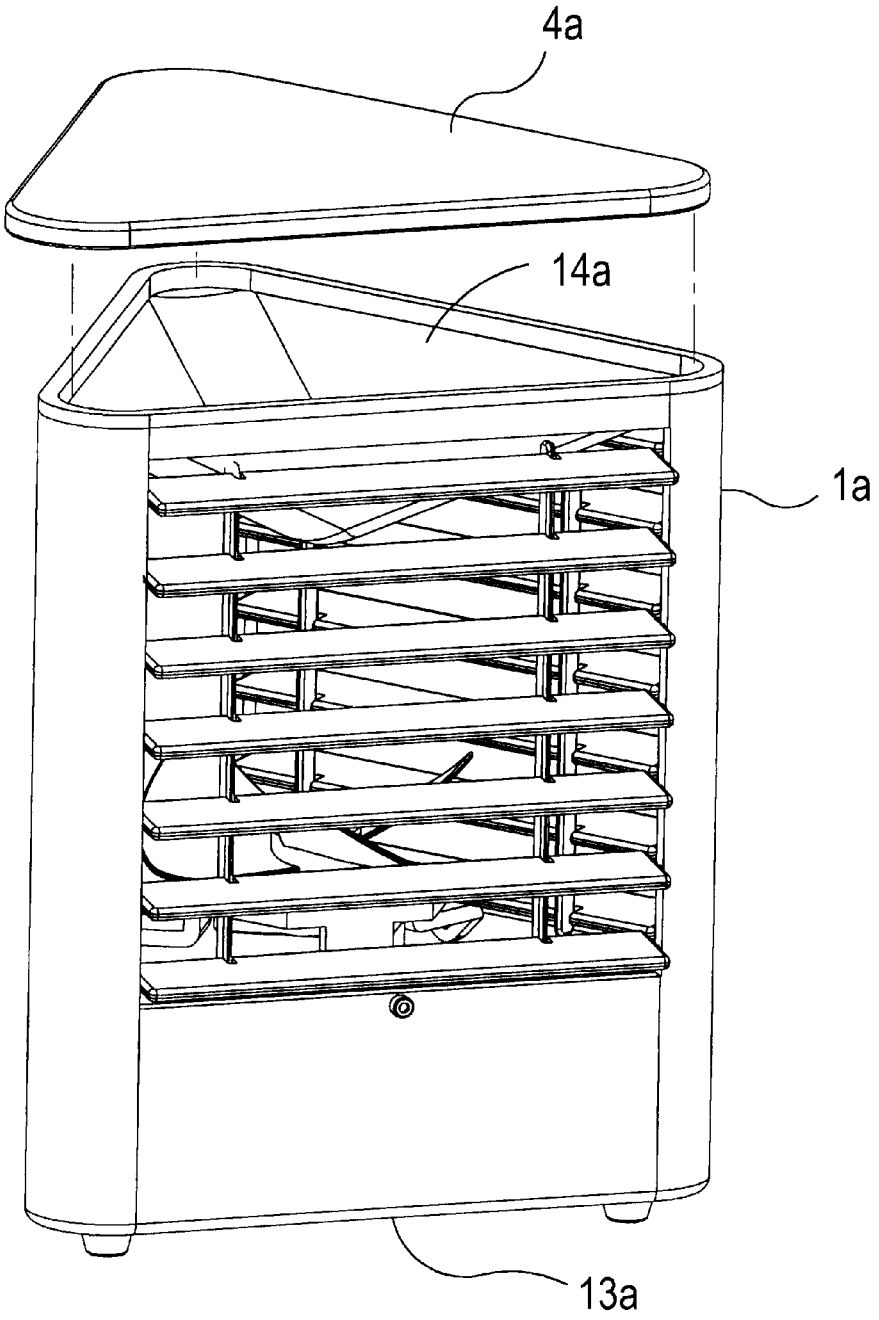
FIG. 6 is the drawing of forth example of an omnidirectional electric fan.
Figure 7:
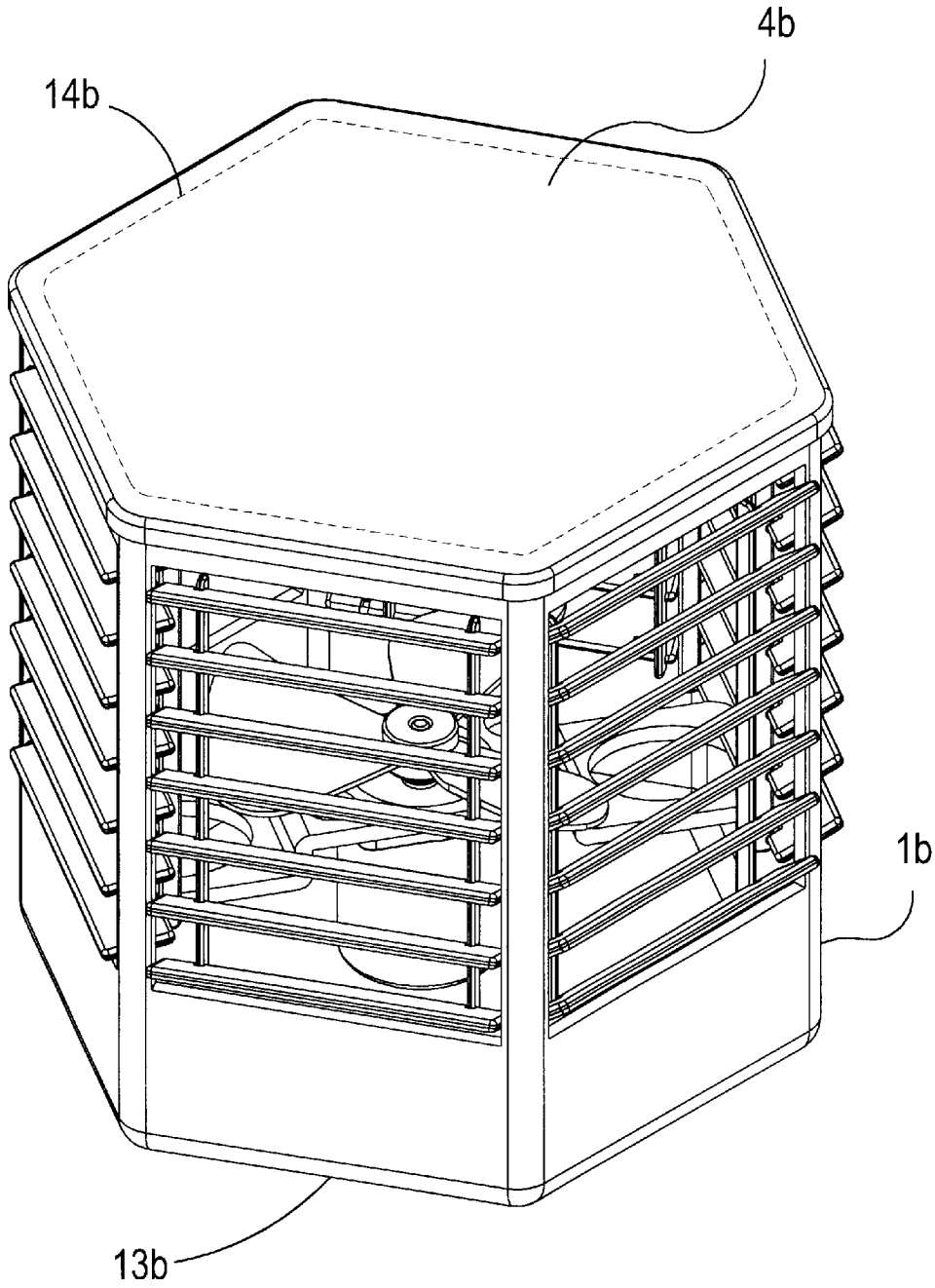
FIG. 7 is the drawing of fifth example of an omnidirectional electric fan.

Referring to FIG. 6 with referring to FIG. 7 in coordination, wherein FIG. 6 is the drawing of forth example of an omnidirectional electric fan and FIG. 7 is the drawing of fifth exemplary of an omnidirectional electric fan, the casing 1 of the present invention can first have an end plane with arbitrary geometric shape according the requirement of the user or the using place, and then be extended vertically to get the effect of omnidirectional air convection. Besides, an upper cover 4*a* or 4*b* can be added according to the requirement of design. As shown in the forth exemplary view of FIG. 6, the end plane 14*a* of the casing 1*a* is triangular. As shown in the fifth exemplary view of FIG. 7, the end plane 14*b* of the casing 1*b* is a hexagon.

Figure 8:
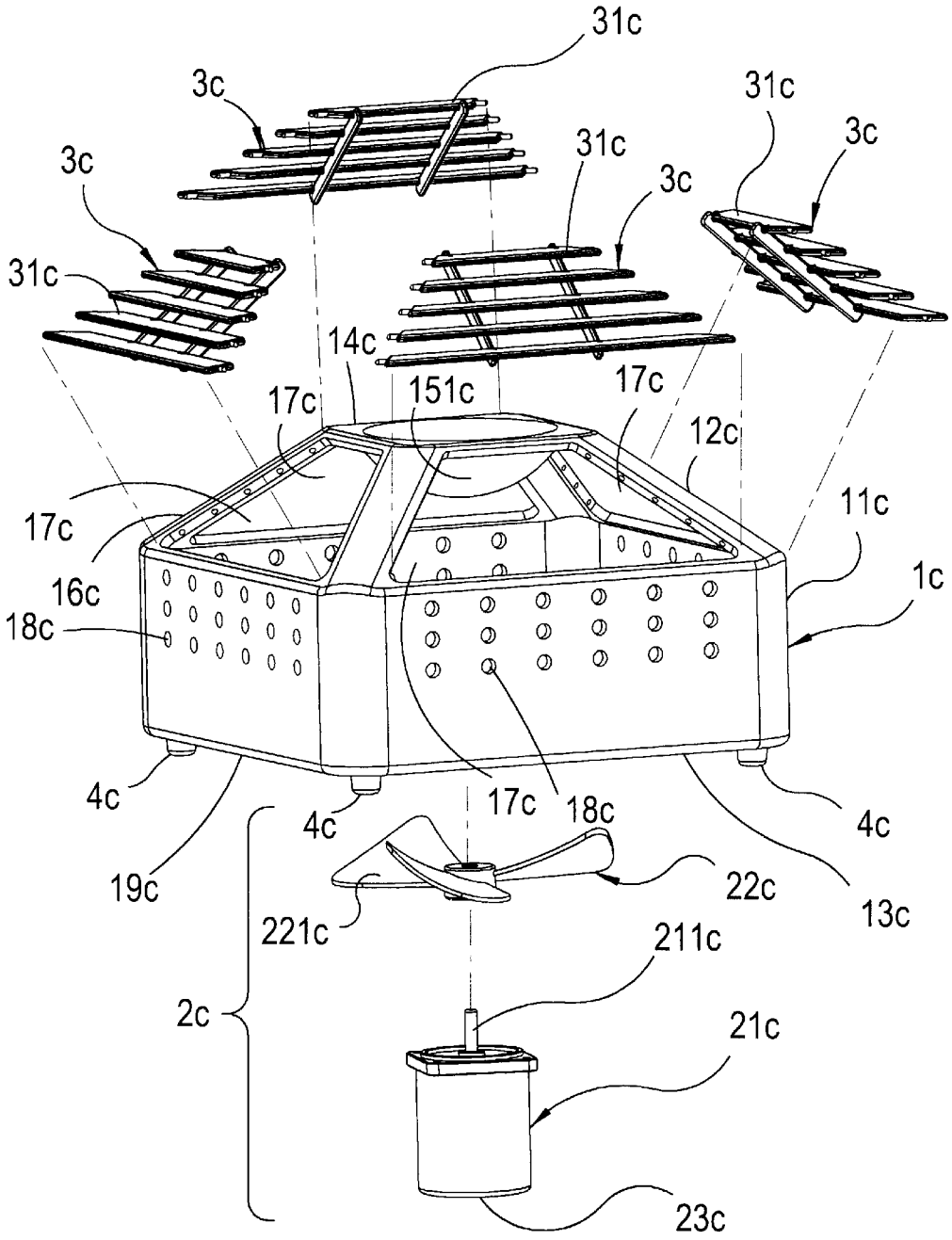
FIG. 8 is the 3D exploded view of sixth example of the present invention, an omnidirectional electric fan.
Figure 9:
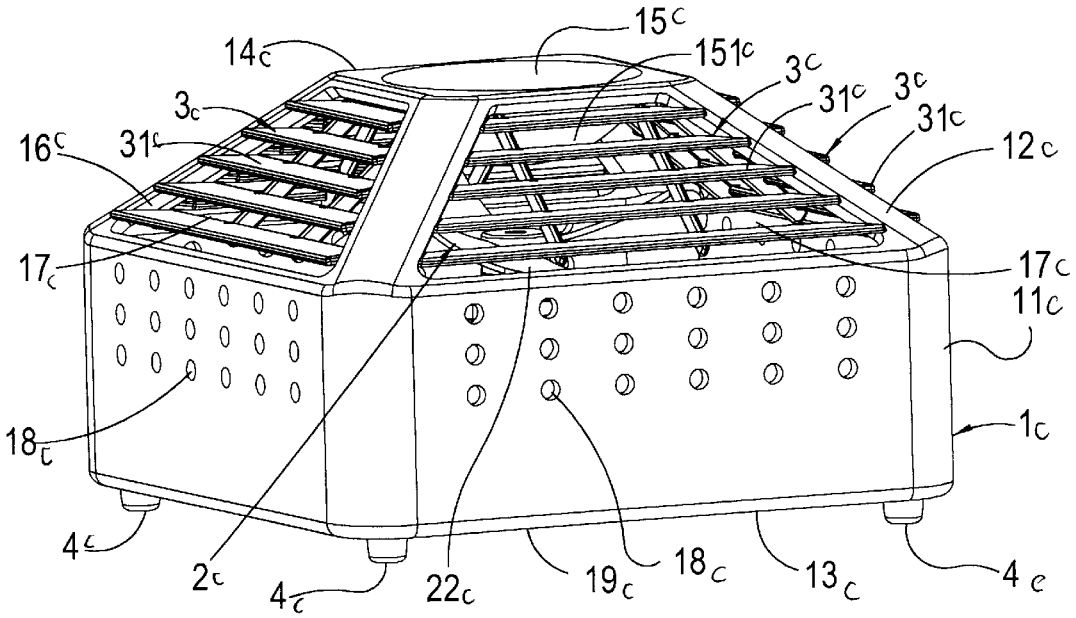
FIG. 9 is the 3D combining view of sixth example of an omnidirectional electric fan.

The present invention can be brought into practice with another structure and assembly. Referring to FIG. 8 and FIG. 9, wherein FIG. 8 is the 3D exploded view of sixth example of the present invention, an omnidirectional electric fan, while FIG. 9 is the 3D combining view of sixth example of an omnidirectional electric fan, an electric fan which can choose multiple directions of the present invention mainly comprises a casing 1*c*, a fan set 2*c*, more than one diffusion plates 3*c* and more than one holding legs 4*c*. The casing 1*c* is a tapered casing 12*c* extended from the polygonal base casing 11*c* with the same number of laterals (the polygonal base casing 11*c* can also be designed to be assembled with the tapered casing 12*c*). The polygonal base casing 11*c* is formed by extending vertically from the end plane 13*c* having an arbitrary geometric shape. Otherwise, a streamlined diversion casing 15*c* is set at the end plane 14*c* of the tapered casing 12*c*, and the front can be shaped together with the later in sole process or be shaped separately. More than one wind outlets 17*c* are set at the ramp tapered plane 16*c* of the tapered casing 12*c*. More than one wind inlets 18*c* having an arbitrary geometric shape are set at the proper positions of the lateral side of the polygonal base casing 11*c*. The fan set 2*c* further includes a motor 21*c*, wherein the bottom 23*c* of the motor 21*c* is locked at the bottom 19*c* inside of the casing 1*c* while the shaft 211*c* of the motor 12 has a fan 22*c*, which is composed of more than one spoiler blades 221*c*. The diffusion plate sets 3*c* are composed of more than one diffusion plates 31*c*, which are rotatory and can respectively set on the more than one wind outlets 17*c* set on the ramp tapered plane 16*c* of the tapered casing 12*c*. The top 151*c* of the streamlined diversion casing 15*c* faces to the fan set 2*c*. The more than one holding legs 4*c* are set at one end side 13*c* of the casing 1*c*.

Figure 10:
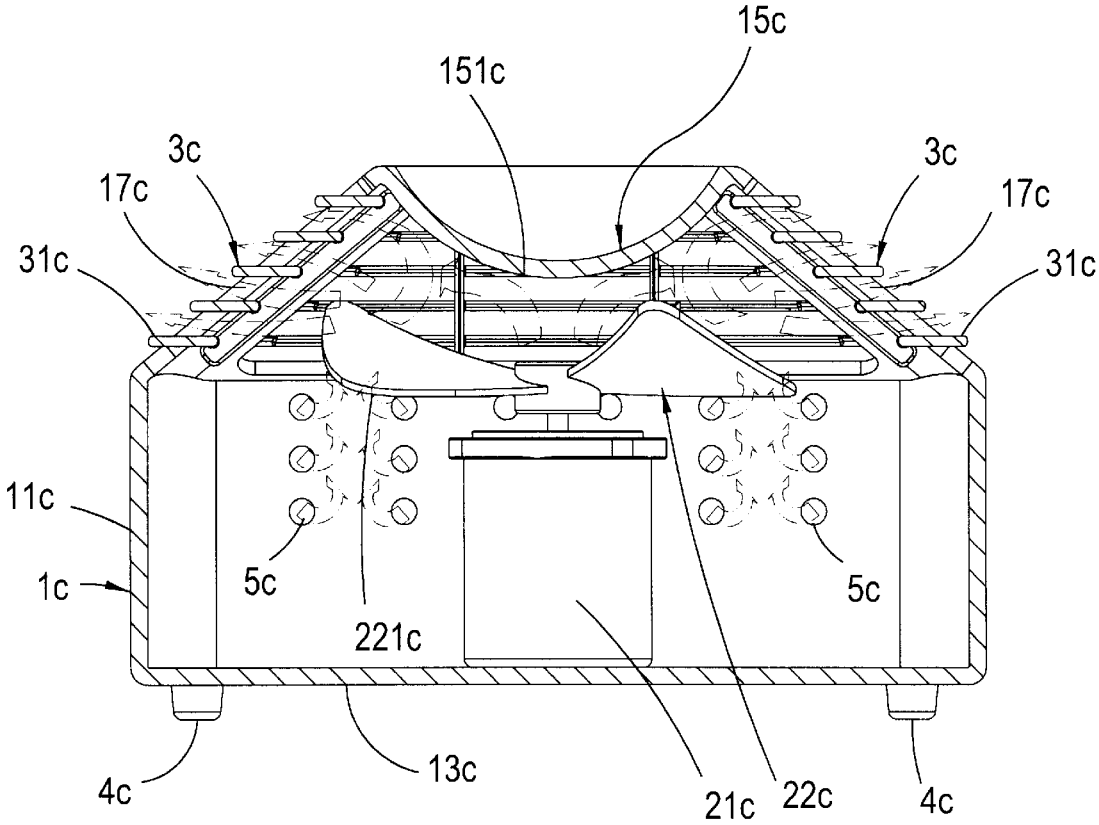
FIG. 10 is the sectional view of the sixth example of an omnidirectional electric fan.

Referring to FIG. 10, which is the sectional view of the sixth example of an omnidirectional electric fan, blades 221*c* of the fan 22*c* can be driven to rotate by connecting the motor 21*c* fastened to the polygonal base casing 11*c* to power to drive the shaft 211*c* of the rotor 21*c*. Air 5*c* is absorbed via the wind inlets 18*c* set on the base casing 11*c* when the spoiler blades 221*c* rotates. Absorbed air 5*c* can be brought by the spoiler blade 221*c* to be gathered at the top 151*c* of the streamlined diversion casing 15*c*. When air is gathered to a certain amount, air 5*c* can be blown out via the wind outlets 17*c* set on the tapered casing 12*c* along the streamlined direction of the streamlined diversion casing 15*c*. By adjusting the diffusion plates 31*c* of the diffusion plate sets 3, the direction of the blowing can be controlled. Air 5*c* can be constantly blown out along the direction controlled by the diffusion plate sets 3*c*. By adjusting the diffusion plate sets 3*c* set on the tapered casing 12*c*, dead angle of the blowing direction and position can be much reduced.

Figure 11:
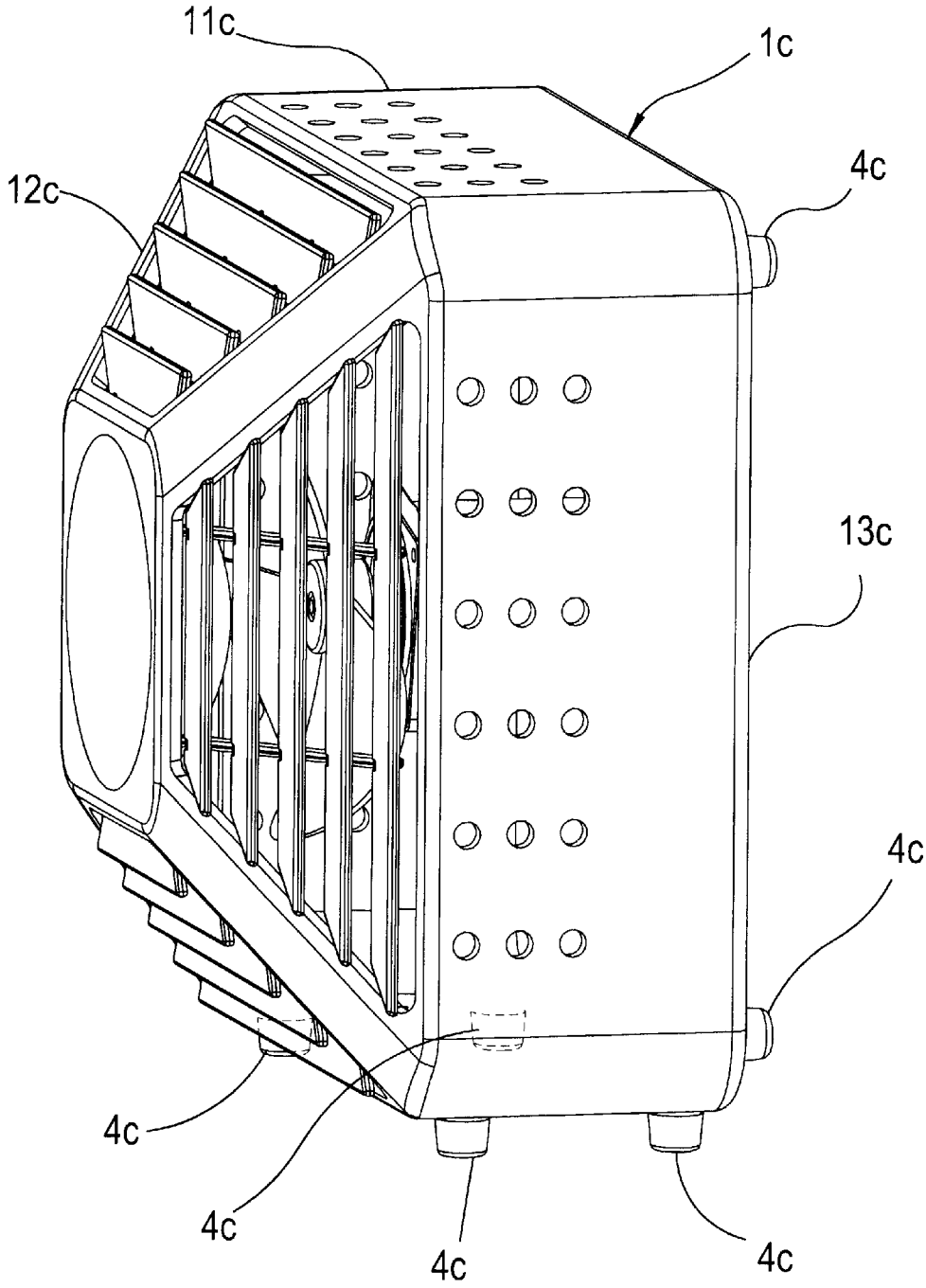
FIG. 11 is the 3D view of the seventh example of an an omnidirectional electric fan.

Referring to FIG. 11, which is the 3D view of the seventh example of an an omnidirectional electric fan, wherein the holding legs 4*c* is not limited to be set at the end plane 13*c* of the casing 1*c* but can be set at arbitrary side of the casing 1*c*. The method not only makes the present invention be convenient to be set in standing way, seat way, or handstand way but also amply employs the function, choosing multi-direction of blowing, of the present invention by using the more than one diffusion plate sets 3*c* set on the tapered casing 12*c* in coordination.

Comparing with other commonly used technologies, the omnidirectional electric fan of the present invention has following advantages:

(1) The present invention needs no additional mechanical transmission to achieve the purpose of blowing wind to multi-direction simultaneously, and thus the producing cost is reduced.

(2) The fan set of the present invention is set inside the casing of the electric fan because the convection of air inside the casing can make the motor included in the fan set enable to be cooled.

(3) The fan set of the present invention is locked inside the casing, and be located inside the corresponding range of the fixed range of the wind outlets, so the present invention can keep the function of air convention even under handstand situation.

(4) The fan casing of the present invention is formed in sole process such that the whole structure is safer and the appearance is more beautiful.

(5) The casing of the present invention is formed in sole process, so the manufacturing of dies is unitary, and the process is simpler such that competitiveness of the industry is increased.

(6) The present invention can substantially reduce the dead angle of the blowing direction and position by adjusting the diffusing plates set on the tapered casing.

(7) A plurality of holding legs can be added to the arbitrary side of the casing of the present invention to make the present invention is convenient to be used under standing way, seat way or handstand way. By coordinating with a plurality of diffusing plate sets, the function of choosing multi-direction of blowing wind is accomplished and is the function other commonly used fans don't have.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An omnidirectional electric fan comprising:

(a) a casing having a pair of end portions and an intermediate portion extending axially therebetween, said intermediate portion having a polygonal sectional contour defined about an inner chamber, said intermediate portion having formed thereon a plurality of wind openings communicating with said inner chamber;

(b) a fan coupled to said casing to be disposed in said inner chamber thereof;

(c) a diversion plate coupled to a first of said end portions of said casing, said diversion plate coaxially opposing said fan and having a protuberant portion extending axially into said inner chamber of said casing; and, (d) a plurality of diffusing plate sets each extending across at least one of said wind openings of said casing, each said diffusing plate set including a plurality of pivotally displaceable diffusion plate members for adjustably guiding air flowing through said wind opening responsive to actuation of said fan.

2. The omnidirectional electric fan as recited in claim 1 wherein said protuberant portion of said diversion plate includes a plurality of substantially planar tapered surfaces.

3. The omnidirectional electric fan as recited in claim 1 wherein said diversion plate is integrally formed with said casing.

4. The omnidirectional electric fan as recited in claim 1 wherein said protuberant portion of said diversion plate is bulbous in contour.

5. The omnidirectional electric fan as recited in claim 1 wherein said polygonal contour defined by said intermediate portion of said casing is selected from the group consisting of: a triangle, a rectangle, and a hexagon.

6. The omnidirectional electric fan as recited in claim 1 wherein each of said diffusion plate members of said diffusing plate sets is formed with a spoiler blade configuration.

7. The omnidirectional electric fan as recited in claim 1 wherein said fan is secured to a second end portion of said casing.

8. The omnidirectional electric fan as recited in claim 7 further comprising a plurality of holding legs supportingly coupled to said second end portion of said casing.

9. The omnidirectional electric fan as recited in claim 7 further comprising a plurality of holding legs supportingly coupled to said first end portion of said casing.

10. An omnidirectional electric fan comprising:

(a) a casing having a pair of end portions and an intermediate portion extending axially therebetween, said intermediate portion defined about an inner chamber, said intermediate portion having a first section extending axially from a second section, said second section having a polygonal sectional contour, said first section being tapered in contour axially toward a first of said end portions, said first and second sections having respectively formed thereon a plurality of first and second wind openings communicating with said inner chamber;

(b) a fan coupled to said casing to be disposed in said inner chamber thereof;

(c) a diversion plate coupled to said first end portion of said casing, said diversion plate coaxially opposing said fan and having a protuberant portion extending axially into said inner chamber of said casing;

(d) a plurality of diffusing plate sets each extending across at least one of said first wind openings of said casing, each said diffusing plate set including a plurality of pivotally displaceable diffusion plate members for adjustably guiding air flowing though said first wind opening responsive to actuation of said fan; and, (e) a plurality of holding legs supportingly coupled to said casing.

11. The omnidirectional electric fan as recited in claim 10 wherein said protuberant portion of said diversion plate is bulbous in contour.

12. The omnidirectional electric fan as recited in claim 10 wherein said polygonal contour defined by said intermediate portion of said casing is selected from the group consisting of: a triangle, a rectangle, and a hexagon.

13. The omnidirectional electric fan as recited in claim 10 wherein each of said diffusion plate members of said diffusing plate sets is formed with a spoiler blade configuration.

14. The omnidirectional electric fan as recited in claim 10 wherein said fan is secured to a second end portion of said casing.

15. The omnidirectional electric fan as recited in claim 14 wherein said holding legs are coupled to said second end portion of said casing.

16. The omnidirectional electric fan as recited in claim 14 wherein said holding legs are coupled to said intermediate portion of said casing.

* * * * *